US007789385B2

(12) United States Patent
Knight

(10) Patent No.: US 7,789,385 B2
(45) Date of Patent: Sep. 7, 2010

(54) BINDING MACHINE

(75) Inventor: Colin Knight, Winnetka, IL (US)

(73) Assignee: ACCO Brands USA LLC, Lincolnshire, IL (US)

( * ) Notice: Subject to any disclaimer, the term of this patent is extended or adjusted under 35 U.S.C. 154(b) by 57 days.

(21) Appl. No.: 11/969,530

(22) Filed: Jan. 4, 2008

(65) Prior Publication Data

US 2008/0164648 A1 Jul. 10, 2008

Related U.S. Application Data

(60) Provisional application No. 60/883,669, filed on Jan. 5, 2007.

(51) Int. Cl.
*B65H 33/04* (2006.01)
*B65H 39/00* (2006.01)

(52) U.S. Cl. ..... 270/58.17; 270/58.07; 270/58.08

(58) Field of Classification Search ..... 270/58.07, 270/58.08

See application file for complete search history.

(56) References Cited

U.S. PATENT DOCUMENTS

| | | | | |
|---|---|---|---|---|
| 1,460,647 | A | 7/1923 | Fruchter | |
| 3,627,152 | A | 12/1971 | Pfaffle | |
| 3,972,525 | A | 8/1976 | Foster et al. | |
| 3,992,002 | A | 11/1976 | Fassman et al. | |
| 4,008,501 | A | 2/1977 | Cutter | |
| 4,442,743 | A | 4/1984 | Szanto | |
| 4,519,284 | A | 5/1985 | Hunter et al. | |
| 4,645,399 | A | 2/1987 | Scharer | |
| 4,764,795 | A | 8/1988 | Burbey | |
| 5,114,130 | A | 5/1992 | Hamanaka et al. | |
| 5,487,634 | A | 1/1996 | Vercillo | |
| 5,732,940 | A * | 3/1998 | Kobayashi et al. | 270/58.01 |
| 6,076,447 | A | 6/2000 | Damask | |
| 6,090,030 | A | 7/2000 | Rogers | |
| 6,216,572 | B1 | 4/2001 | Raimondi | |
| D482,058 | S | 11/2003 | Knight | |
| 2004/0123713 | A1 | 7/2004 | Cofer | |
| 2004/0251612 | A1 | 12/2004 | Kim | |

FOREIGN PATENT DOCUMENTS

| | | |
|---|---|---|
| DE | 4219004 | 12/1993 |
| DE | 4219004 A1 * | 12/1993 |
| DE | 10103190 | 7/2002 |
| JP | 08080383 | 3/1996 |

OTHER PUBLICATIONS

PCT/US2008/050220 International Search Report and Written Opinion with date of mailing of Jul. 29, 2008, 11 pages.

* cited by examiner

*Primary Examiner*—Gene Crawford
*Assistant Examiner*—Yolanda Cumbess
(74) *Attorney, Agent, or Firm*—Michael Best & Friedrich

(57) ABSTRACT

A machine that is operable to create a series of holes in at least one sheet of paper includes a base, a punch mechanism positioned on the base, and a tray coupled to the base. The tray includes a first guide and a second guide. The tray is configured to move between a first position and a second position. Movement of the tray between the first position and the second position adjusts a position of the first guide and a position of the second guide relative to the punch mechanism.

25 Claims, 7 Drawing Sheets

BINDING MACHINE

CROSS-REFERENCE TO RELATED APPLICATIONS

This application claims priority to U.S. Provisional Patent Application No. 60/883,669, filed Jan. 5, 2007, the entire contents of which are hereby incorporated by reference.

BACKGROUND

The present invention relates to a binding machine.

Binding machines allow a user to punch and bind sheets or stacks of papers, so as to form a report, a booklet, etc. A punch mechanism of the binding machine forms a series of holes along one edge of the stack of papers. A binding mechanism then couples a binding member, such as a plastic spine or spiral, to the stack of papers through the series of holes. The punching mechanism and/or the binding mechanism may be manually or electrically operable.

SUMMARY

In one embodiment, the invention provides a machine operable to create a series of holes in at least one sheet. The machine includes a base, a punch mechanism positioned on the base, and a tray coupled to the base. The tray includes a first guide and a second guide. The tray is configured to move between a first position and a second position. Movement of the tray between the first position and the second position adjusts a position of the first guide and a position of the second guide relative to the punch mechanism.

In another embodiment, the invention provides a machine operable to create a series of holes in at least one sheet. The machine includes a base and a punch mechanism coupled to the base and operable to create the series of holes. An axis extends generally perpendicularly from the punch mechanism. The machine also includes a tray coupled to and movable along the base in a substantially oblique direction relative to the axis.

Other aspects of the invention will become apparent by consideration of the detailed description and accompanying drawings.

DETAILED DESCRIPTION

Before any embodiments of the invention are explained in detail, it is to be understood that the invention is not limited in its application to the details of construction and the arrangement of components set forth in the following description or illustrated in the following drawings. The invention is capable of other embodiments and of being practiced or of being carried out in various ways. Also, it is to be understood that the phraseology and terminology used herein are for the purpose of description and should not be regarded as limiting. Certain terminology, for example, "inner," "outer," "left," "right," "top," "bottom," "front," and "rear," are used in the following description for relative descriptive clarity only and do not imply a particular orientation. The use of "including," "comprising," or "having" and variations thereof herein is meant to encompass the items listed thereafter and equivalents thereof as well as additional items. Unless specified or limited otherwise, the terms "mounted," "connected," "supported," and "coupled" and variations thereof are used broadly and encompass both direct and indirect mountings, connections, supports, and couplings. Further, "connected" and "coupled" are not restricted to physical or mechanical connections or couplings.

Figure 1:
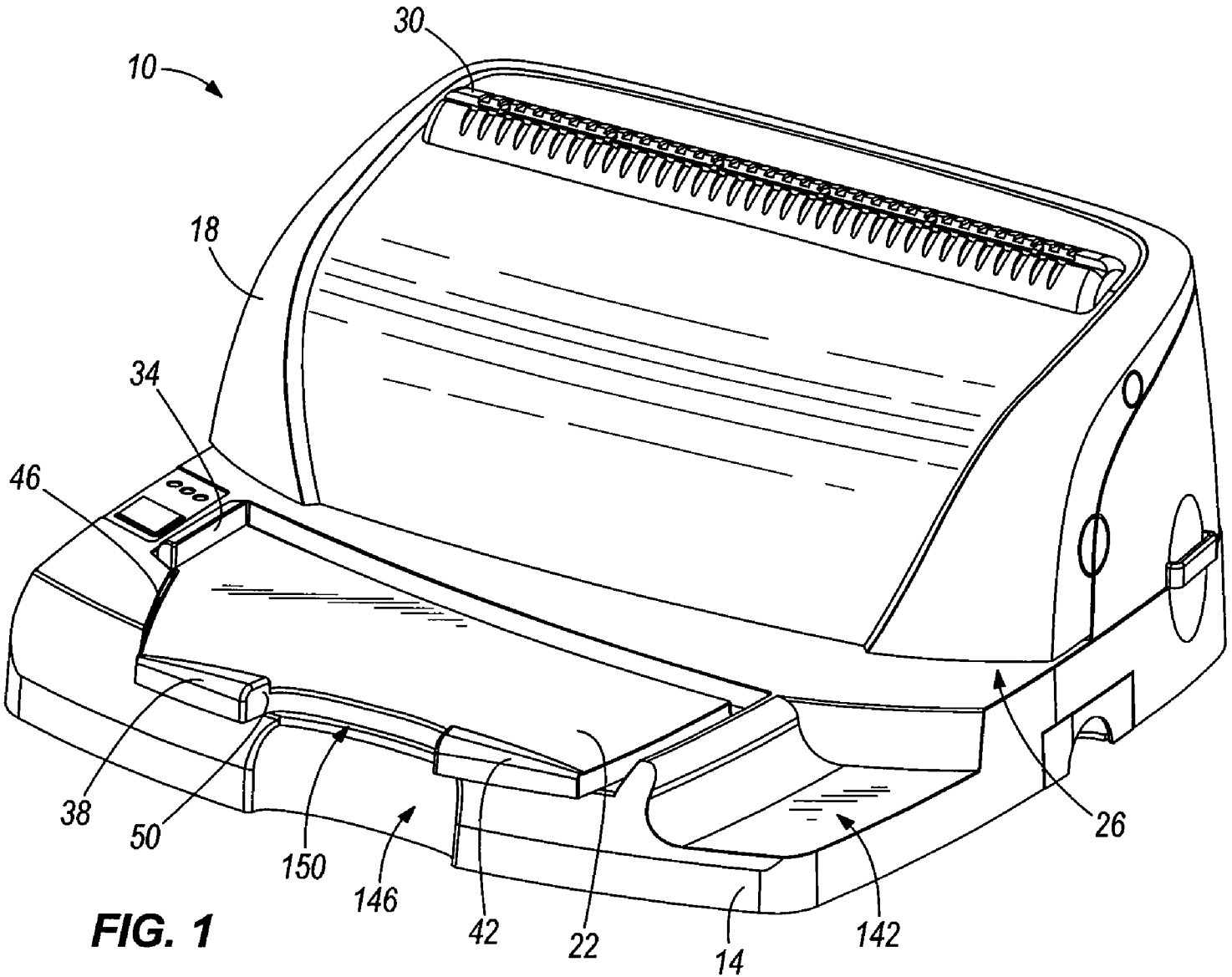
FIG. 1 is a perspective view of a binding machine embodying the present invention.

FIG. 1 illustrates a binding machine 10 of the present invention. The binding machine 10 includes a base 14, a housing 18, and a tray 22. The housing 18 is positioned on one end of the base 14 and covers a punch mechanism 24 (schematically illustrated in FIG. 2A). A slot 26 between the housing 18 and the base 14 allows a sheet or stack of papers to partially enter the housing 18 to be engaged by the punch mechanism 24. The punch mechanism 24 is operable to create a series of holes along an edge of the paper. The series of holes generally corresponds to apertures 28 provided in the base 14 (see FIG. 7) that align with punches of the punch mechanism 24. A binding mechanism 30 is positioned on top of the housing 18 to facilitate attachment of a binding element (e.g., a plastic spine or spiral) to the paper through the series of holes. Reference is made to U.S. Pat. No. 4,645,399, issued Feb. 24, 1987, and U.S. Pat. No. 5,487,634, issued Jan. 30, 1996, the entire contents of both of which are herein incorporated by reference, for additional features and operations of a punch mechanism and a binding mechanism not specifically discussed herein. Although the punch mechanism disclosed in the '399 patent is manually actuated, other punch mechanisms, such as the one discussed with reference to FIG. 1, may be electrically actuated.

The tray 22 is slidably coupled within a cutout portion on the base 14, opposite from the housing 18. The tray 22 includes a first guide 34, a second guide 38, and a third guide 42. The first guide 34, or side guide, is positioned adjacent to a left edge 46 of the tray 22 to abut an edge of the paper, ensuring proper lateral alignment of the paper relative to the punch mechanism 24. The second and third guides 38, 42, or paper-in guides, are positioned on a front edge 50 of the tray 22, generally perpendicular to the first guide 34. The second and third guides 38, 42 abut an edge of the paper adjacent to the edge abutting the first guide 34 and opposite from the edge of the paper to be punched, ensuring the paper is inserted fully into the punch mechanism 24. In addition, the third guide 42 prevents rotation of the paper relative to the first guide 34 and the second guide 38, making sure the paper is inserted squarely (e.g., perpendicularly) into the housing 18, relative to the punch mechanism 24. As such, the guides 34, 38, 42 ensure that the series of holes is consistently created on an edge of the paper such that, when the binding element is coupled through the series of holes, the papers are neatly aligned.

In the illustrated embodiment, the guides 34, 38, 42 are integrally formed with the tray 22. In other embodiments, the guides 34, 38, 42 may be separate elements attached to the tray 22 by, for example, fasteners and/or an adhesive. In addition, in some embodiments, the second and third guides 38, 42 may take the form of a single paper-in guide positioned along a portion of or substantially all of the front edge 50 of the tray 22.

Figure 2A:
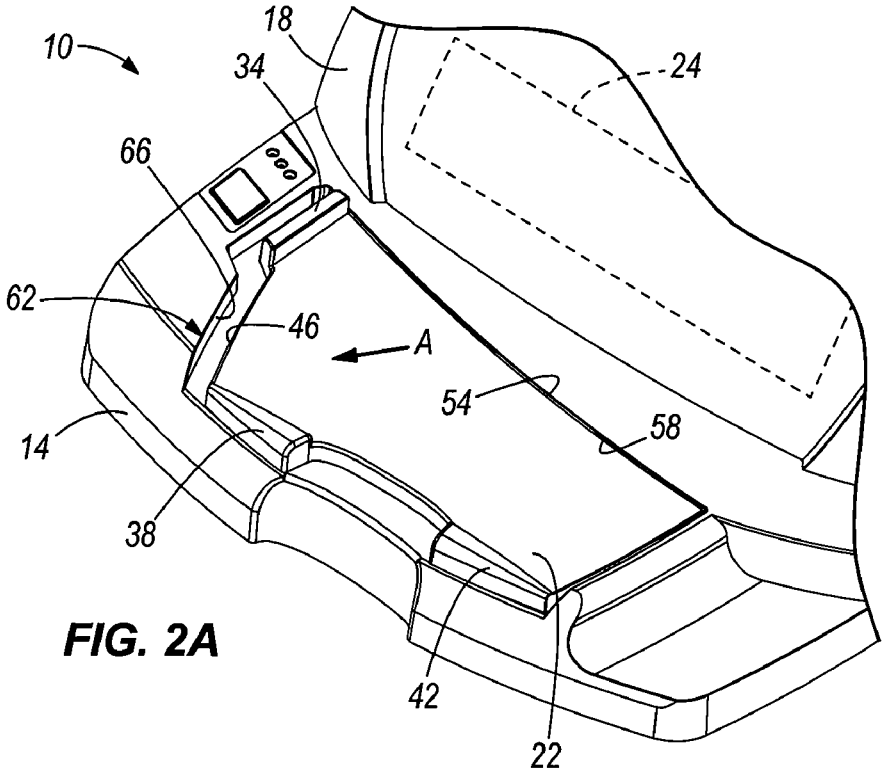
FIG. 2A is a partial perspective view of the binding machine shown in FIG. 1, illustrating a tray in a first position.
Figure 2B:
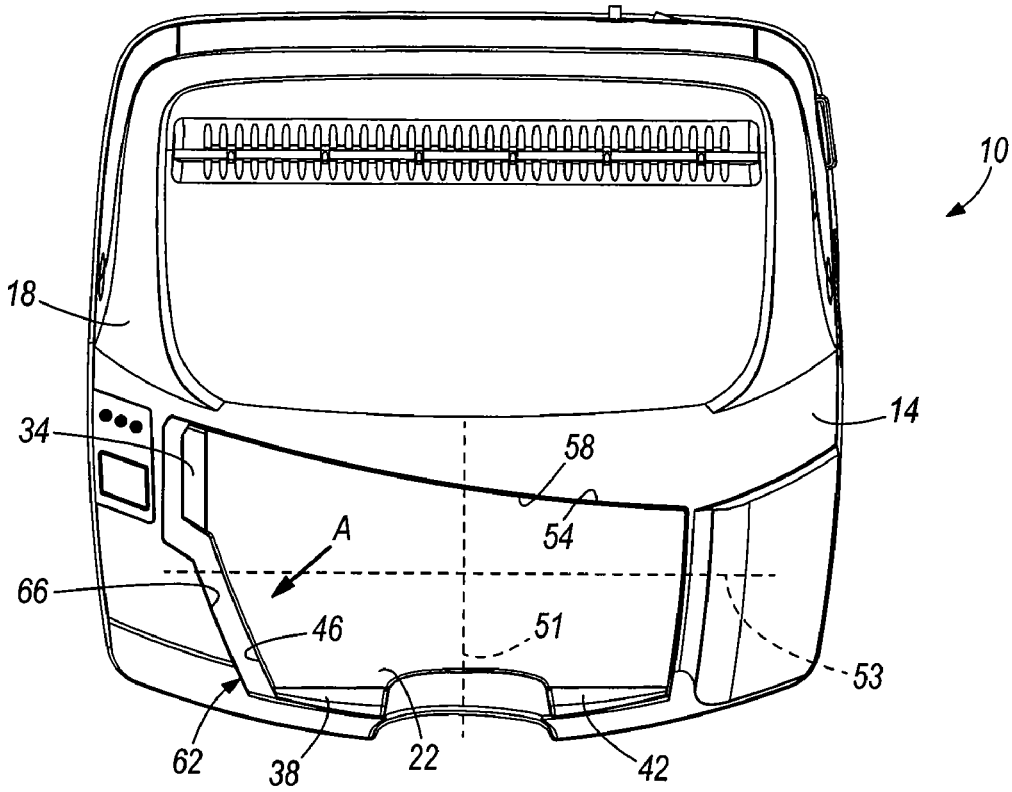
FIG. 2B is a top view of the binding machine shown in FIG. 2A.
Figure 3A:
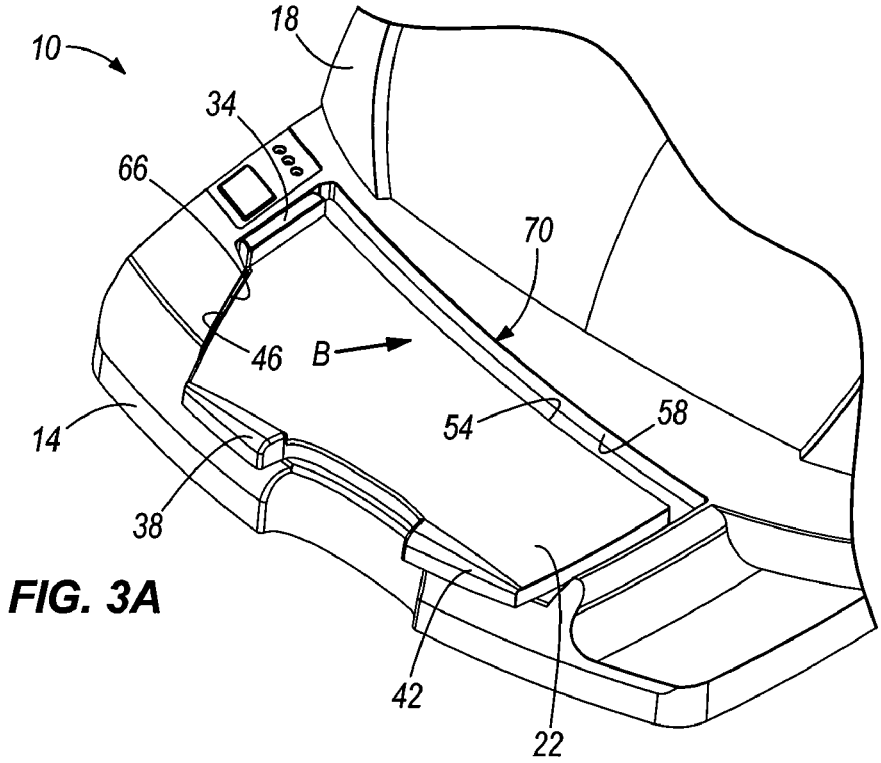
FIG. 3A is a partial perspective view of the binding machine shown in FIG. 1, illustrating the tray in a second position.
Figure 3B:
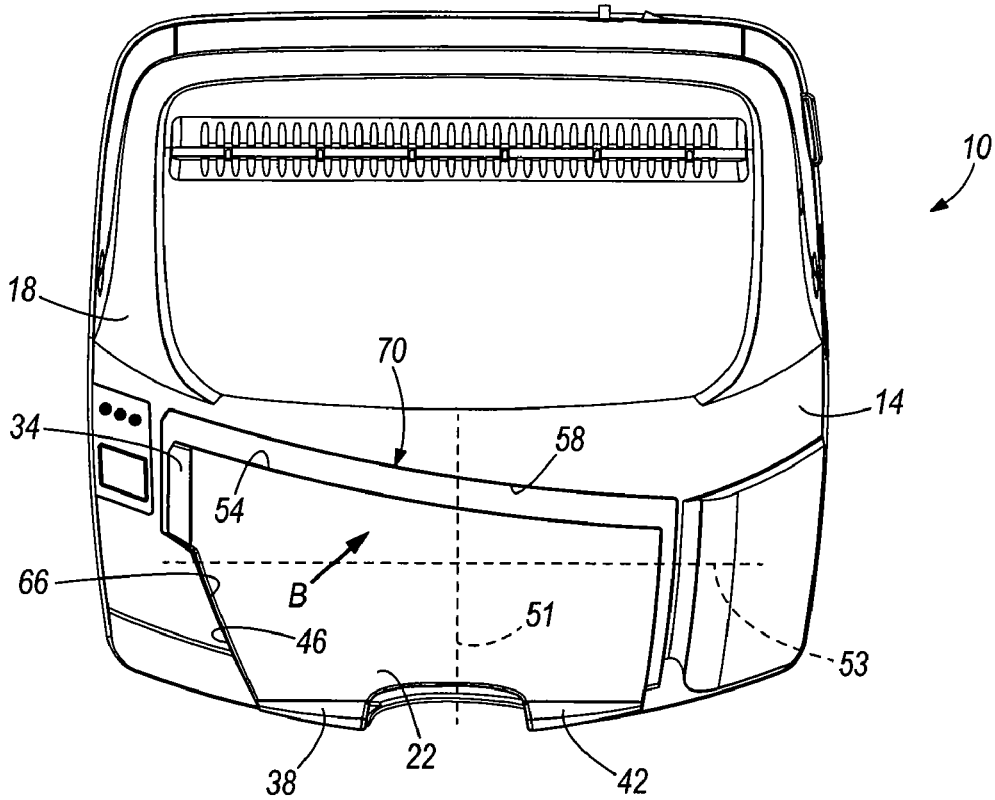
FIG. 3B is a top view of the binding machine shown in FIG. 3A.

The tray 22 facilitates proper alignment of standard-sized paper (e.g., 8.5 inches by 11 inches) while in a first position (see FIGS. 2A and 2B) and oversized paper (e.g., 8.75 inches by 11.25 inches), such as an oversized cover, while in a second position (see FIGS. 3A and 3B). In some embodiments, the tray 22 may be modified to align other sized papers, such as, for example, A4 paper while in the first position and a corresponding oversized cover while in the second position.

The tray 22 is operable to move relative to the base 14 to change between the first position and the second position. The tray 22 moves in an oblique or diagonal direction relative to an in-feed axis 51 (see FIGS. 2B, 3B, and 7) extending perpendicularly from the apertures 28, and therefore the punch mechanism 24, and a lateral axis 53 extending across the tray 22, perpendicular to the in-feed axis 51 (i.e., substantially parallel to the apertures 28). Referring to FIGS. 2A and 2B, movement of the tray 22 from the first position to the second position generally corresponds to the direction of arrow A. Referring to FIGS. 3A and 3B, movement of the tray 22 from the second position to the first position generally corresponds to the direction of arrow B. In the illustrated embodiment, the tray 22 slides diagonally between the first and second positions such that the first guide 34 moves about an eighth of an inch along (e.g., parallel with) the lateral axis 53, and the second and third guides 38, 42 move about a quarter of an inch along (e.g., parallel with) the in-feed axis 51. In embodiments where the tray 22 is configured for different sized paper, the guides 34, 38, 42 may move different distances.

In operation, the punch mechanism 24 creates a series of holes along an edge of a standard-sized paper or papers when the tray 22 is in the first position. The tray 22 is then moved to the second position such that the punch mechanism 24 may create a series of holes along an edge of an oversized paper or papers (e.g., covers). When the standard-sized paper is combined with the oversized paper (e.g., a sheet of oversized paper is positioned on one or both sides of the standard-sized paper to act as a cover), both series of holes align such that the papers are easily coupled with a binding element.

Referring to FIGS. 2A and 2B, when the tray 22 is in the first position, or standard sheet position, the first, second, and third guides 34, 38, 42 are positioned to properly align standard-sized papers with the punch mechanism 24. As such, the tray 22 is positioned on the base 14 such that a rear edge 54 of the tray 22 is adjacent to an inner edge 58 of the cutout portion and a gap 62 exists between the left edge 46 of the tray 22 and a left edge 66 of the cutout portion.

Referring to FIGS. 3A and 3B, when the tray 22 is in the second position, or cover sheet position, the first, second, and third guides 34, 38, 42 are positioned to properly align oversized papers with the punch mechanism 24. As such, the tray 22 is positioned on the base 14 such that the left edge 46 of the tray 22 is adjacent to the left edge 66 of the cutout portion and a gap 70 exists between the rear edge 54 of the tray 22 and the inner edge 58 of the cutout portion.

Figure 4:
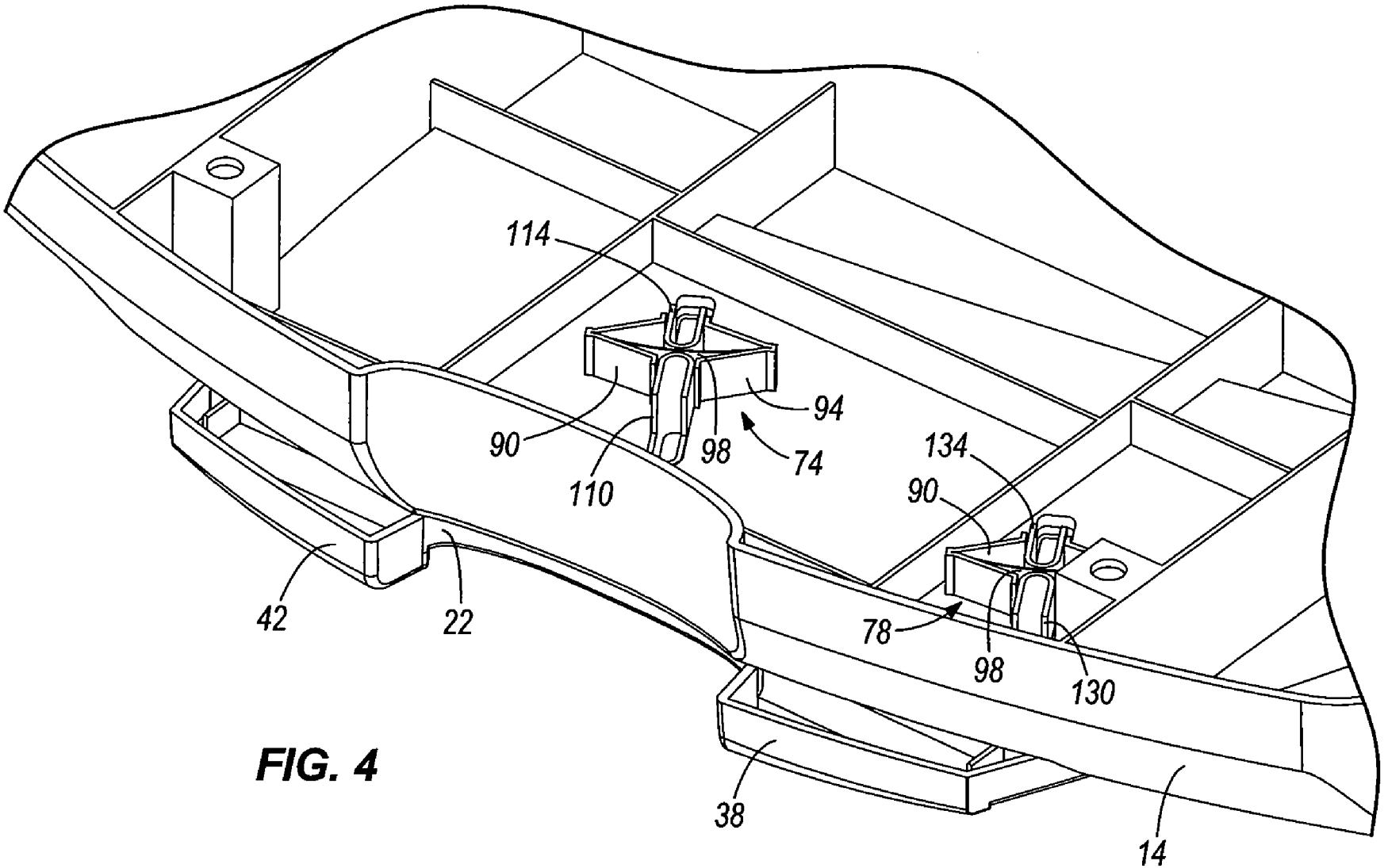
FIG. 4 is a partial perspective view of an underside of the binding machine shown in FIG. 1.

FIG. 4 illustrates an underside of the binding machine 10. A first spring assembly 74 and a second spring assembly 78 are positioned on a bottom of the base 14 adjacent to a first slot 82 and a second slot 86 (see FIG. 7), respectively. Although only the first spring assembly 74 is described here in detail, the second spring assembly 78 is substantially similar to the first spring assembly 74, and like parts have been given the same reference numerals.

Figure 5:
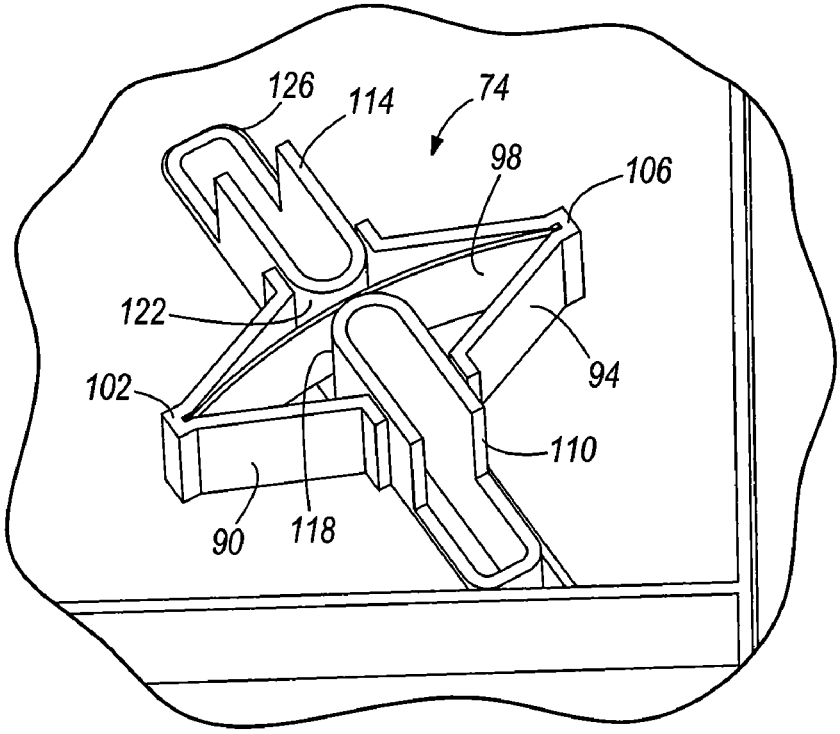
FIG. 5 is an enlarged partial perspective view of FIG. 4, illustrating a spring assembly in a first position.

FIG. 5 illustrates the first spring assembly 74 in a first position corresponding to the first position of the tray 22. The first spring assembly 74 includes a first V-shaped support 90, a second V-shaped support 94, and a spring member 98. The first and second supports 90, 94 are positioned at a midpoint on opposing sides of the first slot 82. The first and second supports 90, 94 are oriented such that the V-shapes of the supports 90, 94 open towards each other. The spring member 98 (e.g., a flexible steel strip) extends between the first support 90 and the second support 94 and is slightly longer than the distance between an apex 102 of the first support 90 and an apex 106 of the second support 94. As such, while in the first position, the spring member 98 is curved towards the housing 18.

The tray 22 includes a first boss 110 and a second boss 114 extending downwardly through the first slot 82 on opposite sides of the spring member 98. Each boss 110, 114 includes a rounded surface 118, 122 abutting the spring member 98 so as to not disrupt the curvature of the spring member 98. The first and second bosses 110, 114 slide with the tray 22 between the first position and the second position. In the first position, the second boss 114 is adjacent to one end 126 of the first slot 82. As shown in FIG. 4, the tray 22 also includes a third boss 130 and a fourth boss 134 extending downwardly through the second slot 86 and functioning in a similar manner to the first boss 110 and the second boss 114.

Figure 6:
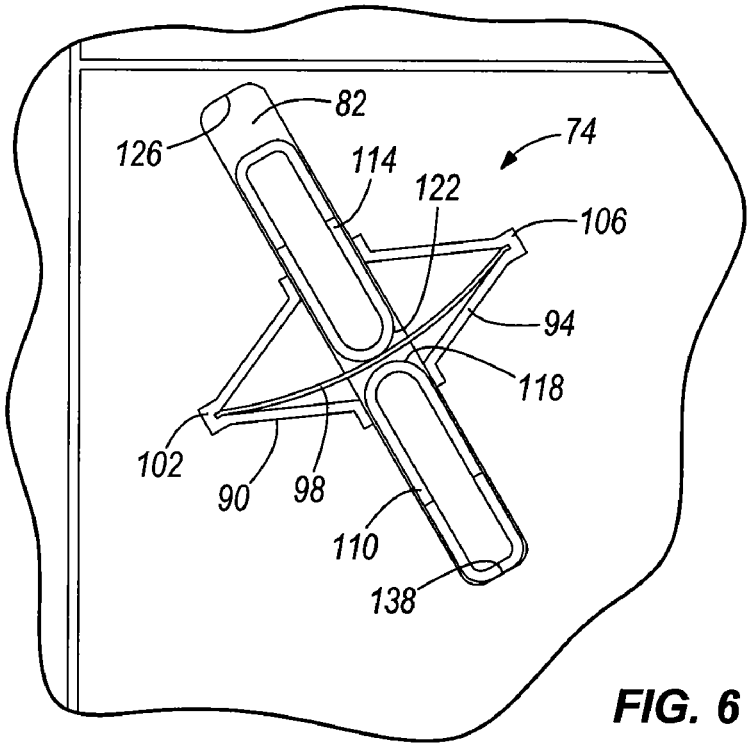
FIG. 6 is an enlarged partial plan view of the spring assembly shown in FIG. 5 in a second position.

FIG. 6 illustrates the first spring assembly 74 in a second position corresponding to the second position of the tray 22. In the second position, the first boss 110 is adjacent to a second end 138 of the first slot 82 and the spring member 98 is curved away from the housing 18.

Figure 7:
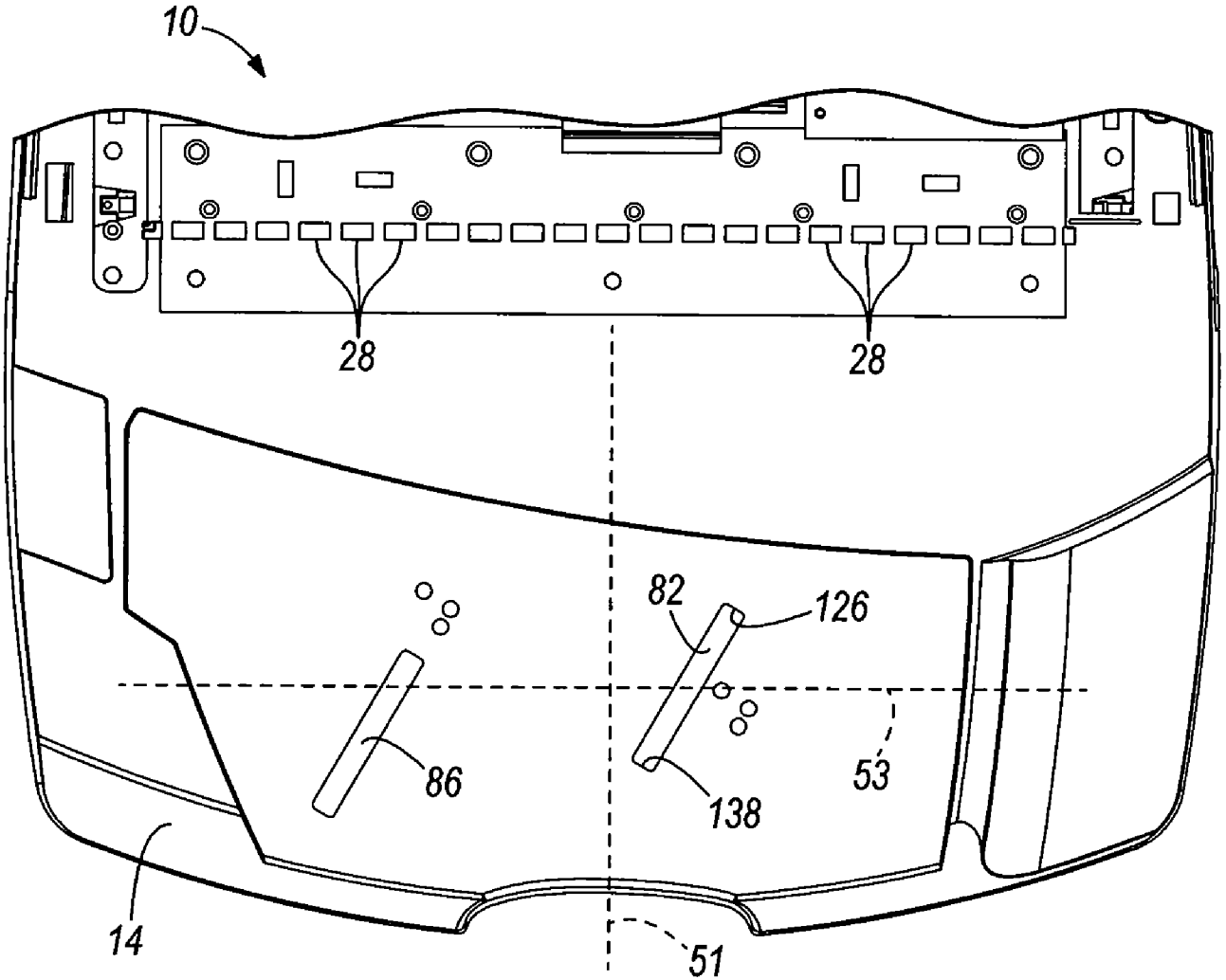
FIG. 7 is a top view of a base of the binding machine of FIG. 1 shown without the tray.

FIG. 7 is a top view of the binding machine 10 without the tray 22. In the illustrated embodiment, the first and second slots 82, 86 extend through the base 14 obliquely or diagonally relative to both the in-feed axis 51 and the lateral axis 53. As such, the first and second slots 82, 86 only allow the tray 22 to travel along one path (e.g., the direction indicated by arrows A and B in FIGS. 2A-3B) and, thereby, minimize positioning error of the guides 34, 38, 42.

In operation, a user pulls the tray 22 from the first position toward the second position, causing the second boss 114 to push the spring member 98 away from the housing 18 and change the curvature of the spring member 98 from the first position (shown in FIG. 5) to the second position (shown in FIG. 6). Bending the spring member 98 slightly past center (i.e., where the spring member 98 is relatively straight between the supports 90, 94) causes the spring member 98 to bias the first boss 110, and therefore the tray 22, completely to the second position. As such, the first spring assembly 74 can be considered an over-center switch actuatable between the first position and the second position, with substantially no positions therebetween. In other embodiments, the tray could be movable between more than two predetermined positions, or could be configured to provide non-fixed, variable positioning along a path of movement.

Likewise, a user may push the tray 22 from the second position toward the first position, causing the first boss 110 to push the spring member 98 toward the housing 18. Therefore, the spring member 98 bends slightly past center, changes curvature, and biases the second boss 114 and the tray 22 completely to the first position.

While the illustrated tray 22 is configured to be moved manually by the user (e.g., by hand), in some embodiments, movement of the tray 22 may be facilitated by a lever positioned on the binding machine 10. Actuation of the lever may cause movement of the tray 22 between the first position and the second position. Additionally or alternatively, an electric switch may be provided on the binding machine 10 to automatically move the tray 22 between the first and second positions.

Although the binding machine 10 has been described with reference to a specific example, it should be readily apparent to one skilled in the art that modifications may be made to facilitate proper alignment of the paper without departing from the spirit of the present invention. For example, the first guide 34 may be positioned on an edge of the tray 22 opposite from the left edge 46 to ensure alignment along the lateral axis 53. Furthermore, the tray 22 may include fewer or more guides than the amount illustrated, and the tray 22 may include both a guide positioned on the left edge 46 and a guide positioned on the edge opposite from the left edge 46. Additionally or alternatively, the tray 22 may move in a direction substantially perpendicular to the direction indicated by arrows A and B or along a different path (e.g., curved, Z-shaped, etc.) between the first position and the second position, and perhaps to additional positions. Moreover, the direction, configuration, and orientation of the slots 82, 86 may be altered to accommodate for different sizes of paper, different tray positions, or different punching alignments (e.g., along another edge of the paper).

Referring back to FIG. 1, the base 14 includes a recess 142 and a notch 146, and the tray 22 includes a notch 150. The recess 142 is positioned near an edge of the base 14 to facilitate placement and removal of paper on the binding machine 10 by allowing a user to slide a hand between the base 14 and the paper. The base notch 146 and the tray notch 150 are positioned near the front edge 50 of the tray 22 to likewise facilitate placement and removal of paper on the binding machine 10. In addition, the base notch 146 and the tray notch 150 allow the user to gently tap the paper toward the housing 18 such that the paper slides over and rests adjacent to the second guide 38 and the third guide 42.

Figure 8:
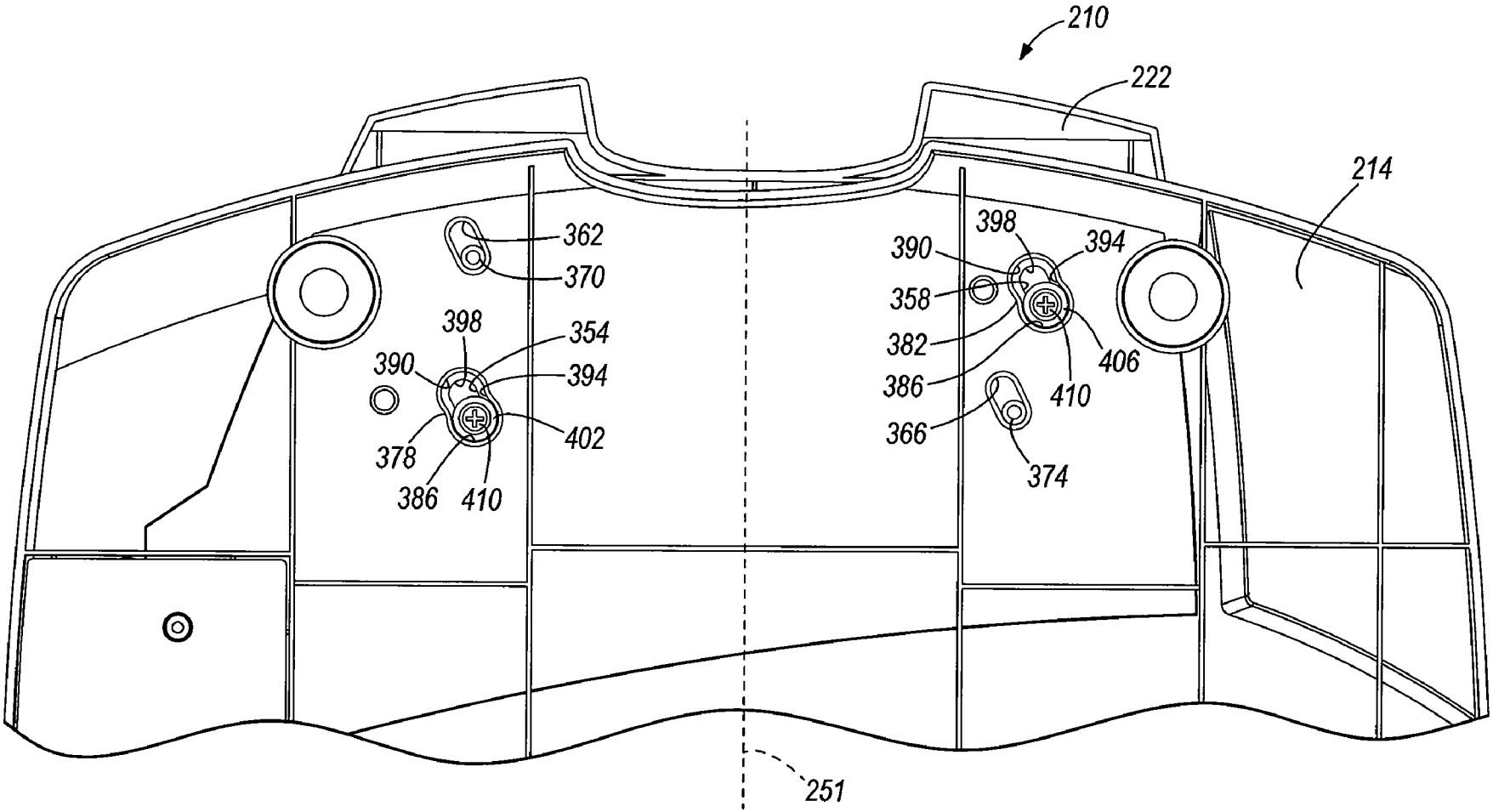
FIG. 8 is an underside view of a binding machine according to a second embodiment of the invention.

FIG. 8 illustrates a binding machine 210 according to another embodiment of the invention. The illustrated binding machine 210 is similar to the binding machine 10 discussed above with respect to FIGS. 1-7, and like parts have been give the same reference number plus 200.

In the illustrated embodiment, the base 214 includes four slots 354, 358, 362, 366 and the tray 222 includes four bosses 370, 374 (although only two are shown). Similar to the slots 82, 86 discussed above, the illustrated slots 354, 358, 362, 366, or apertures, are arranged obliquely or diagonally relative to the in-feed axis 251. The illustrated base 214 also includes a first guide wall 378 and a second guide wall 382 adjacent to and surrounding the first slot 354 and the second slot 358, respectively. Each guide wall 378, 382 defines two detents 386, 390 and a neck portion 394 disposed between the detents 386, 390. As shown in FIG. 8, the first detents 386 are adjacent to one end of each slot 354, 358 and the second detents 390 are adjacent to an opposite end 398.

Each boss 370, 374 extends through one of the slots 354, 358, 362, 366 to guide the tray 222 between the first, or standard sheet, position and the second, or cover sheet, position. As shown in FIG. 8, a first bushing 402, or projection, is coupled to and extends downwardly from the first boss and a second bushing 406 is coupled to and extends downwardly from the second boss. In the illustrated embodiment, the bushings 402, 406 are composed of a plastic material and coupled to the bosses by fasteners 410 (e.g., bolts, screws, or the like). In other embodiments, the bushings 402, 406 may be composed of other materials and/or may be coupled to the bosses using other suitable fastening means.

In the illustrated embodiment, the bushings 402, 406 slide within the guide walls 378, 382 between the detents 386, 390 to releasably secure the tray 222 in the first position and the second position. For example, the first detents 386 correspond to the first position of the tray 222 and the second detents 390 correspond to the second position of the tray 222. The illustrated detents 386, 390 have approximately the same diameter as the outside diameter of the bushings 402, 406, while the neck portions 394 have a width that is slightly less than the outside diameter of the bushings 402, 406 such that the guide walls 378, 382 and/or the bushings 402, 406 deflect as the tray 222 moves between the first and second positions. The neck portions 394 thereby inhibit the bushings 402, 406 from remaining in an intermediate position between the first detent 386 and the second detent 390.

In FIG. 8, the tray 222 is in the standard sheet position (i.e., the first position). Similar to the tray 22 discussed above, a user may pull the illustrated tray 222 to the cover sheet position (i.e., the second position). As the tray 222 moves from the first position to the second position, the bushings 402, 406 slide out of the first detents 386, through the neck portions 394, and into the second detents 390. Likewise, the user may push the tray 222 from the second position to the first position, causing the bushings 402, 406 to slide out of the second detents 390, through the neck portions 394, and into the first detents 386.

Various features and advantages of the invention are set forth in the following claims.

What is claimed is:

1. A machine operable to create a series of holes in at least one sheet, the machine comprising:

a base;

a punch mechanism coupled to the base and operable to create the series of holes, wherein an axis extends generally perpendicularly from the punch mechanism; and a tray coupled to and movable along the base in an oblique direction relative to the axis, the tray being positioned relative to the punch mechanism to support the at least one sheet during creation of the series of holes by the punch mechanism.

2. The machine of claim 1, wherein the base includes a recess positioned to facilitate removal of the at least one sheet from the base.

3. The machine of claim 1, wherein the base includes a notch positioned to facilitate positioning of the at least one sheet relative to the punch assembly.

4. The machine of claim 1, wherein the tray includes a notch positioned to facilitate positioning of the at least one sheet relative to the punch assembly.

5. The machine of claim 1, wherein the tray includes a first guide configured to align the at least one sheet in a direction generally perpendicular to the axis and a second guide configured to align the at least one sheet in a direction generally parallel to the axis.

6. The machine of claim 5, wherein movement of the tray in the oblique direction moves the first guide at least in a direction perpendicular to the axis and the second guide at least in a direction parallel to the axis.

7. The machine of claim 6, wherein the tray is movable between first and second positions such that the first guide moves about one-eighth of an inch in a direction perpendicular to the axis, and the second guide moves about one-quarter of an inch in a direction parallel to the axis when the tray is moved from the first position to the second position.

8. The machine of claim 1, wherein the base includes an aperture extending in the oblique direction and the tray includes a boss, and wherein the aperture is configured to receive the boss to facilitate movement of the tray in the oblique direction.

9. The machine of claim 8, wherein the tray includes a projection coupled to the boss and the base includes a detent adjacent to the aperture, and wherein the projection is configured to engage the detent to releasably secure the tray in a position relative to the base.

10. The machine of claim 9, wherein the projection is a bushing secured to the boss.

11. The machine of claim 9, wherein the detent is a first detent, wherein the base further includes a second detent adjacent the aperture, and wherein the projection is configured to engage the first detent to releasably secure the tray in a first position relative to the base and is configured to engage the second detent to releasably secure the tray in a second position relative to the base.

12. The machine of claim 11, wherein the second detent is separated from the first detent by a neck portion.

13. The machine of claim 8, wherein the base includes a spring assembly to bias the tray in the oblique direction, and wherein the boss is configured to engage the spring assembly.

14. The machine of claim 13, wherein the spring assembly operates as an over-center switch in moving the tray between first and second positions.

15. The machine of claim 8, wherein the base includes a second aperture spaced apart from the first-mentioned aperture and extending in the oblique direction and the tray includes a second boss, and wherein the second aperture is configured to receive the second boss to facilitate movement of the tray in the oblique direction.

16. A machine operable to create a series of holes in at least one sheet, the machine comprising:

a base;

a punch mechanism coupled to the base and operable to create the series of holes, wherein an axis extends generally perpendicularly from the punch mechanism; and a tray coupled to and movable along the base in an oblique direction relative to the axis;

wherein the base includes one of an aperture extending in the oblique direction and a boss, and the tray includes the other of the aperture extending in the oblique direction and the boss, and wherein the aperture is configured to receive the boss to facilitate movement of the tray in the oblique direction.

17. The machine of claim 16, further comprising a second aperture spaced apart from the first-mentioned aperture and extending in the oblique direction, and a second boss, and wherein the second aperture is configured to receive the second boss to facilitate movement of the tray in the oblique direction.

18. The machine of claim 16, further comprising a spring assembly to bias the tray in the oblique direction, and wherein the boss is configured to engage the spring assembly.

19. The machine of claim 18, wherein the spring assembly operates as an over-center switch in moving the tray between first and second positions.

20. The machine of claim 16, further comprising a projection coupled to the boss and a detent adjacent to the aperture, and wherein the projection is configured to engage the detent to releasably secure the tray in a position relative to the base.

21. The machine of claim 20, wherein the projection is a bushing secured to the boss.

22. The machine of claim 20, wherein the detent is a first detent, and wherein the machine further includes a second detent adjacent the aperture, and wherein the projection is configured to engage the first detent to releasably secure the tray in a first position relative to the base and is configured to engage the second detent to releasably secure the tray in a second position relative to the base.

23. The machine of claim 22, wherein the second detent is separated from the first detent by a neck portion.

24. A machine operable to create a series of holes in at least one sheet, the machine comprising:

a base;

a punch mechanism coupled to the base and operable to create the series of holes, wherein an axis extends generally perpendicularly from the punch mechanism; and a tray coupled to and movable along the base in an oblique direction relative to the axis, the tray being positioned relative to the punch mechanism to support the at least one sheet during creation of the series of holes by the punch mechanism;

wherein the tray includes a first guide configured to align the at least one sheet in a direction generally perpendicular to the axis and a second guide configured to align the at least one sheet in a direction generally parallel to the axis; and wherein movement of the tray in the oblique direction moves the first guide at least in a direction perpendicular to the axis and the second guide at least in a direction parallel to the axis.

25. The machine of claim 24, wherein the tray is movable between first and second positions such that the first guide moves about one-eighth of an inch in a direction perpendicular to the axis, and the second guide moves about one-quarter of an inch in a direction parallel to the axis when the tray is moved from the first position to the second position.

* * * * *